United States Patent [19]

Richards

[11] Patent Number: 5,022,106

[45] Date of Patent: Jun. 11, 1991

[54] INVALID HOISTS

[75] Inventor: Derek J. Richards, Gloucester, England

[73] Assignee: Arjo Mecanaids Limited, Gloucester, England

[21] Appl. No.: 462,463

[22] Filed: Jan. 9, 1990

[51] Int. Cl.[5] ..... A61G 7/10

[52] U.S. Cl. ..... 5/86; 5/81 R; 4/300; 4/564

[58] Field of Search ..... 414/592, 921, 680; 5/81 R, 83, 86–89; 4/300, 564

[56] References Cited

U.S. PATENT DOCUMENTS

| | | | |
|---|---|---|---|
| 3,310,816 | 3/1967 | James et al. | 5/83 |
| 3,940,808 | 3/1976 | Petrini | 5/89 X |
| 3,998,284 | 12/1976 | James | 5/86 X |
| 4,682,377 | 7/1987 | Reich | 5/86 |
| 4,703,523 | 11/1987 | James | 5/86 X |
| 4,712,257 | 12/1987 | James | 5/86 X |
| 4,837,874 | 6/1989 | Giercarz et al. | 5/83 |
| 4,918,771 | 4/1990 | James | 5/86 X |

FOREIGN PATENT DOCUMENTS

| | | | |
|---|---|---|---|
| 338272 | 6/1959 | Switzerland | 5/87 |
| 2140773 | 8/1986 | United Kingdom . | |
| 2194491 | 3/1988 | United Kingdom . | |

*Primary Examiner*—David A. Bucci

*Attorney, Agent, or Firm*—Young & Thompson

[57] ABSTRACT

In order to raise infirm or disabled persons from a sitting to a generally standing position, a hoist comprises a mast, a carrier movable along the mast, and a U-shaped lifting member which is connected at its closed end to an upper end of the mast for pivotable movement about a horizontal axis and which at its open part provides laterally spaced attachment points for the attachment of a body sling. The hoist also includes a U-shaped strut pivotably connected at its closed end to the carrier and at its open part to the open part of the lifting member, and an operating mechanism for raising and lowering the carrier along the mast to thereby move the attachment points along an arcuate path. The operating mechanism is self-locking at any chosen position. Such a hoist is capable of being used for lifting of persons of widely differing heights and builds.

13 Claims, 6 Drawing Sheets

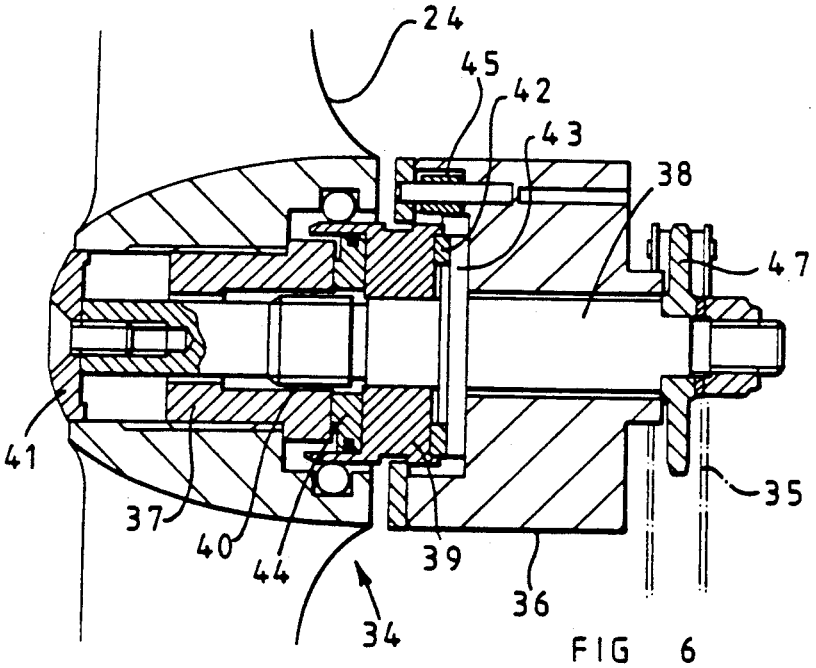
FIG 6
FIG 7
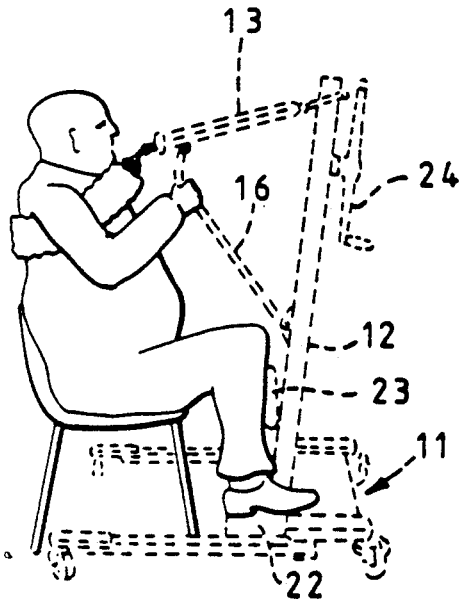
FIG 8
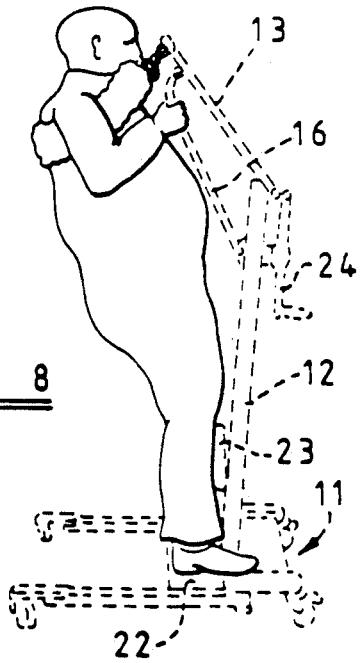

INVALID HOISTS

INTRODUCTION

This invention relates to invalid hoists and more particularly to such hoists for raising infirm and disabled persons from a sitting to a generally standing position.

GB Patent Specification No. 2 140 773 describes an invalid hoist for raising infirm or disabled persons from a sitting to a generally standing position and comprising a mobile chassis, a support column upstanding from the vehicle chassis, a pivotable lifting arm projecting from the support column and providing laterally spaced attachment points for the attachment of a padded body sling positioned around the back of a seated patient below the arms thereof, a footplate or footrests on the chassis, and an operating lever for raising the lifting arm. The operating lever is pivotably mounted on the side of the support column opposite to the lifting arm and is coupled to the lifting arm by a mechanical linkage. The mechanical linkage includes an over-centre mechanism such that the lifting arm is self-locking in a raised position only and the linkage provides a mechanical advantage such that movement of the lever through about 180° will raise the arm through a lifting arc of about 60°-65°.

This known arrangement suffers from a number of drawbacks. Firstly, it is not possible to cater for both short and tall persons without some adjustment to the length of the lifting arm as the operating lever must be moved through its entire operating arc in order to reach a self-locking position. Secondly, the lifting effort required to raise heavy patients is often too great for a single attendant to handle comfortably. Thirdly, the required operating space is large due to the length of the operating lever. Fourthly, due to the limited and non-variable operating range of the lifting arm the sling must be short enough to raise slim patients and when such a sling is used to raise heavier patients non-padded parts of the sling may be positioned under the patient's armpits rendering the sling uncomfortable.

The present invention seeks to provide an invalid hoist which largely overcomes at least some of the drawbacks of the known hoist.

SUMMARY OF THE INVENTION

According to the present invention there is provided an invalid hoist for raising infirm or disabled persons from a sitting to a generally standing position, the hoist comprising a mast, a carrier movable along the mast, a U-shaped lifting member which is connected at its closed end to an upper end of the mast for pivotable movement about a horizontal axis and which at its open part provides laterally spaced attachment points for the attachment of a body sling, a U-shaped strut pivotably connected at its closed end to the carrier and at its open part to the open part of the lifting member, and operating means for raising and lowering the carrier along the mast to thereby move the attachment points along an arcuate path, the operating means being self-locking at any chosen position.

Preferably, the operating means comprises a rotary drive mechanism which is self-locking at any chosen position and a flexible elongate element connecting the drive mechanism to the carrier. In this case, preferably the rotary drive mechanism includes drive and driven members screw-threadably connected together with a clutch plate therebetween, the clutch plate being rotatable only in that direction which results in a raising of the carrier and in which rotation of the drive member tends to tighten the screw-threaded connection between the drive and driven members so that a lowering of the carrier can be is achieved by rotating the drive member in an opposite direction which tends to loosen the screw-threaded connection between the drive and driven members and which allows the driven member to slip relative to the clutch plate under the force applied by the flexible elongate element only so long as the drive member continues to undergo rotation. In this case, rotation of the clutch plate in an opposite direction may be prevented by a ratchet and pawl mechanism.

Advantageously, the flexible elongate element is anchored at one end to the mast and has a downwardly extending loop between the drive mechanism and the anchoring point, the lower end of the loop passing below guide means on the carrier and the downward extent of the loop being variable by operation of the drive mechanism to raise or lower the carrier and hence the lifting member.

Preferably, the flexible elongate element is a chain which co-operates with a sprocket wheel of the drive mechanism. Alternatively, the flexible elongate element could be a toothed or V-section belt which cooperates with a pulley of the drive mechanism.

Conveniently, the arms of the U-shaped strut are cranked upwards near their free ends in order to provide a clearance between the arms of the strut and the arms of the lifting member when the latter is in a fully elevated position so that a patient can hold onto the arms of the strut without risk of having hands trapped between the strut and the lifting member.

Preferably, the hoist also comprises a mobile chassis supporting the mast and foot resting means.

In this case, the chassis conveniently comprises a main support member on which the mast and the foot resting means are provided, and two side members extending forwardly of the main support member, the side members being swivellable relative to the support member so that they can be spread apart to enable the chassis to straddle a chair on which a patient is seated. The chassis may also be provided with a removable seat which can be fitted into sockets in the two side members.

Conveniently, the hoist includes knee abutment means supported by the mast.

Conveniently, the body sling comprises a padded part having attachment chords at opposite ends. The attachment chords may be guided through respective tubular members forming a part of the lifting member and may be engageable with jamb cleats, or other appropriate fastening devices, provided on the lifting member. In this case, preferably at least part of each jamb cleat is housed in a respective tubular guide member in order to ensure that, after the sling has been placed around a body of a patient and tensioned to a desired degree by an attendant, the attachments chords, when released, will always engage respective jamb cleats.

The operating arc of the lifting member can be longer than in the known arrangement due to the self-locking nature of the rotary drive mechanism and hence the ability to arrest the lifting member at any chosen position. Therefore, it is possible to cater for both short and tall persons without adjustment to the length of the lifting member. For the same reason it is also possible to provide a single sling which can raise patients of all builds in comfort. The shape of the strut is such as to afford clearance for the patient's body during lifting, thus not impeding movement of a patient to a generally standing position. The rotary drive mechanism can be operated by a manually operable handle arranged to rotate in a vertical or near vertical plane, thus significantly reducing the space required to operate the hoist as compared with the known hoist. Moreover, the lifting mechanism can be provided with a greater mechanical advantage than the known hoist so as to reduce the lifting effort required to lift heavy patients.

The invention will now be more particularly described, by way of example only, with reference to the accompanying drawings.

BRIEF DESCRIPTION OF THE DRAWINGS

FIG. 6 is a side detail sectional view of the rotary drive mechanism of the hoist, FIGS. 7 and 8 show the operation of the hoist.

DESCRIPTION OF THE PREFERRED EMBODIMENTS

Figure 1:
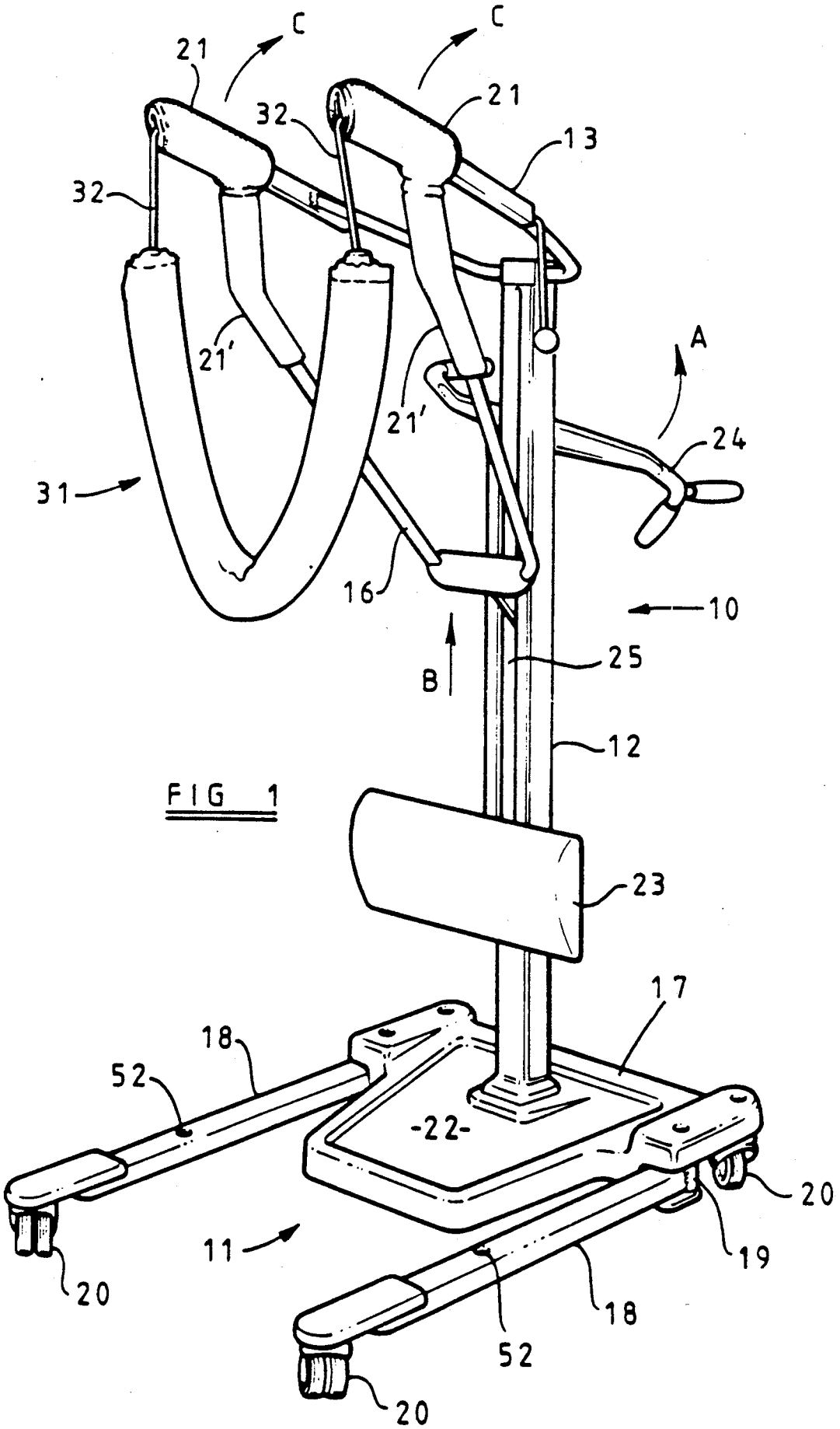
FIG. 1 is a perspective view taken from the front and one side of one embodiment of a hoist according to the invention.
Figure 3:
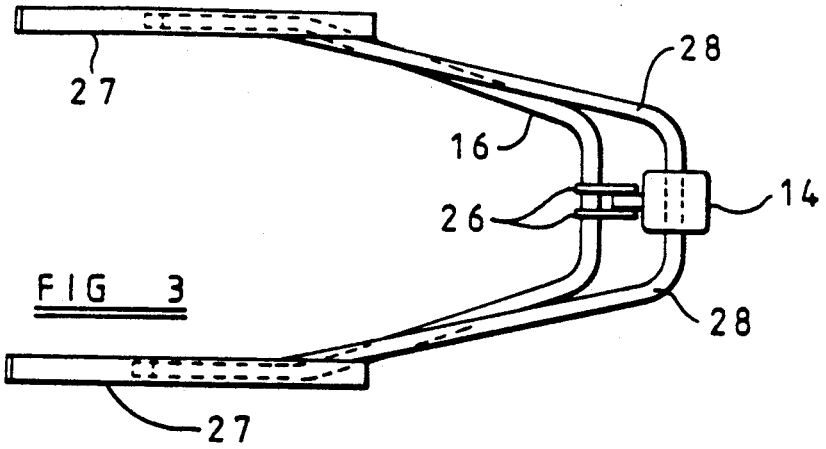
Figure 2:
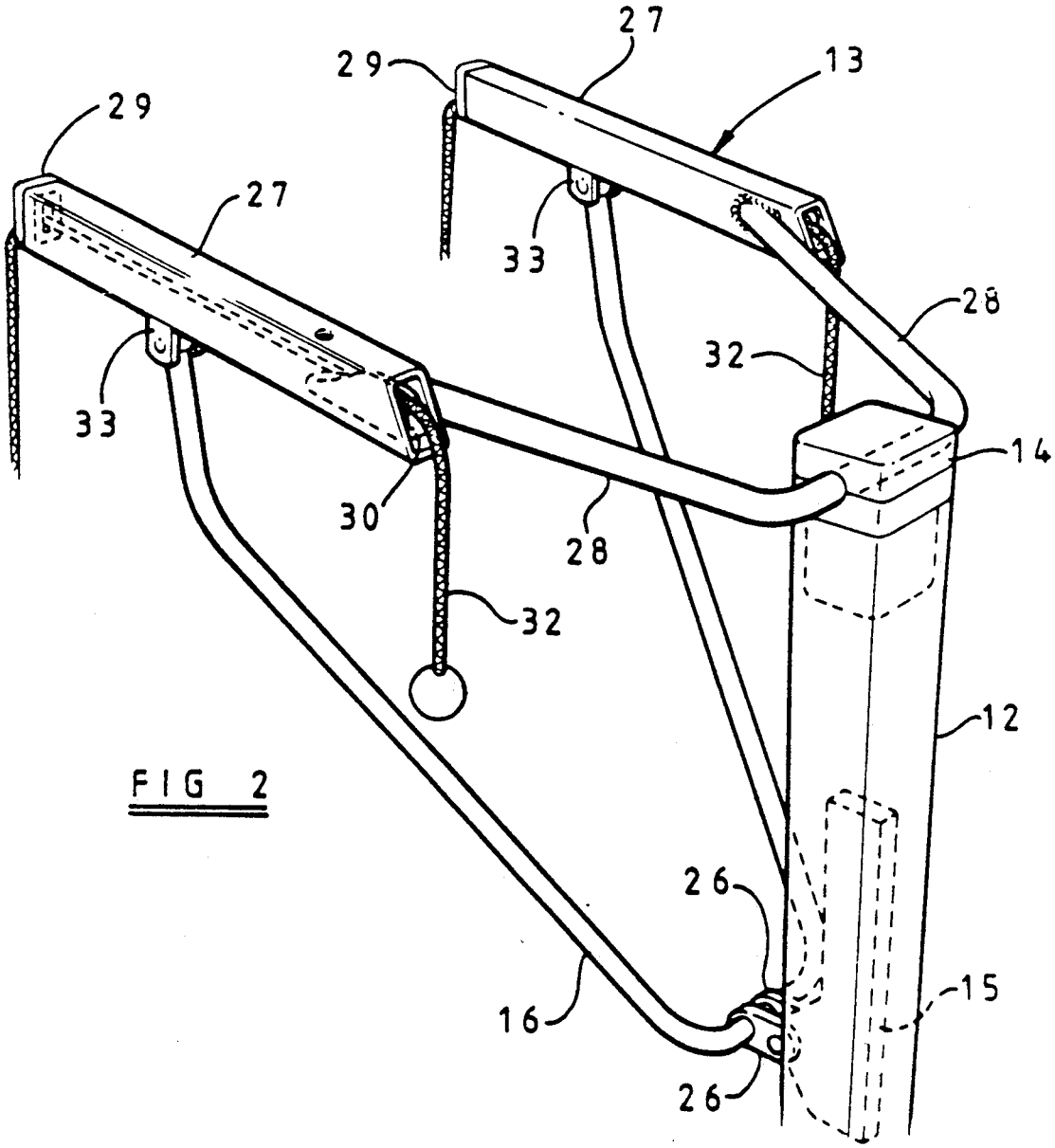
FIG. 2 is a perspective view taken from the rear and one side of the upper part of the hoist of FIG. 1, with parts removed, FIG. 3 a plan view of the upper part of the hoist shown in FIG. 2, FIGS. 4 and 5 are respectively rear and side detail sectional views of part of the hoist of FIG. 1.

Referring to the drawings, the invalid hoist shown therein comprises a lifting mechanism 10 mounted on a mobile chassis 11.

The lifting mechanism 10 comprises a hollow vertical mast 12 of square box section, a U-shaped lifting member 13 pivotably supported at its closed end in a pivot block 14 fixed to the upper end of the mast 12, a carrier in the form of a carriage 15 movable along the inside of the mast 12, and a U-shaped strut 16 pivotably connected at its closed end to the carriage 15 and at its open end to the U-shaped lifting member 13.

The chassis 11 comprises a main support member 17 to which the lower end of the mast 12 is secured, and two side members 18 which extend forwardly of the support member 17. The side members 18 are connected at their rearward ends to the main support member 17 by respective swivel connections 19 so that they can be spread apart at their forward ends to straddle a chair and so that they can be moved inwards to the position shown in FIG. 1 to allow the hoist to pass through a door opening.

The chassis 11 is provided with four swivel castors 20, two on the support member 17 and one on each of the side members 18. The two castors 20 on the main support member 17 are provided with foot operable brake levers (not shown) to hold the chassis 11 in a rest position.

A recessed footrest 22 is formed as an integral part of the support member 17 and projects well forwards of the mast 12, and a knee abutment pad 23 is fixed by a bracket (not shown) to the front wall of the mast 12.

The mast 12 has an elongate vertical slot 25 in its front wall and the closed end of the strut 16 is pivotably connected to lugs 26 which form part of the carriage 15 and which project through the slot 25. The lugs 26 are relatively short so that the connection between the lugs 26 and the closed end of the strut 16 is in close proximity to the front wall of the mast 12. This, coupled with the position of the pivot axis of the lifting member 13 and the open nature of both the lifting member 13 and strut 16, ensures that the lifting mechanism 10 does not impede movement of a patient to a standing position.

The lifting member 13 includes two parallel spaced apart tubular guides 27 of square box section which are joined to the closed end of the lifting member 13 by converging arms 28. The outer or forward end of each guide 27 is fitted with a plastics ferrule 29 and a jamb cleat 30 is fixed to and almost entirely housed within the inner or rearward end of each guide 27. If desired, the forward end of each guide 27 can be enclosed in a padded sleeve 21 as shown in FIG. 1.

A body sling 31 is attached to the lifting member 13. The sling 31 has a padded central part and two attachment chords 32. The chords 32 extend through respective guides 27 which define laterally spaced attachment points, and are clamped in respective jamb cleats 30.

The arms of the strut 16 are cranked upwards at their free ends where they are pivotably connected to respective brackets 33 fixed to the undersides of the guides 27. The cranked ends of the strut 16 may also be enclosed in a padded sleeve 21' as shown in FIG. 1.

Figure 4:
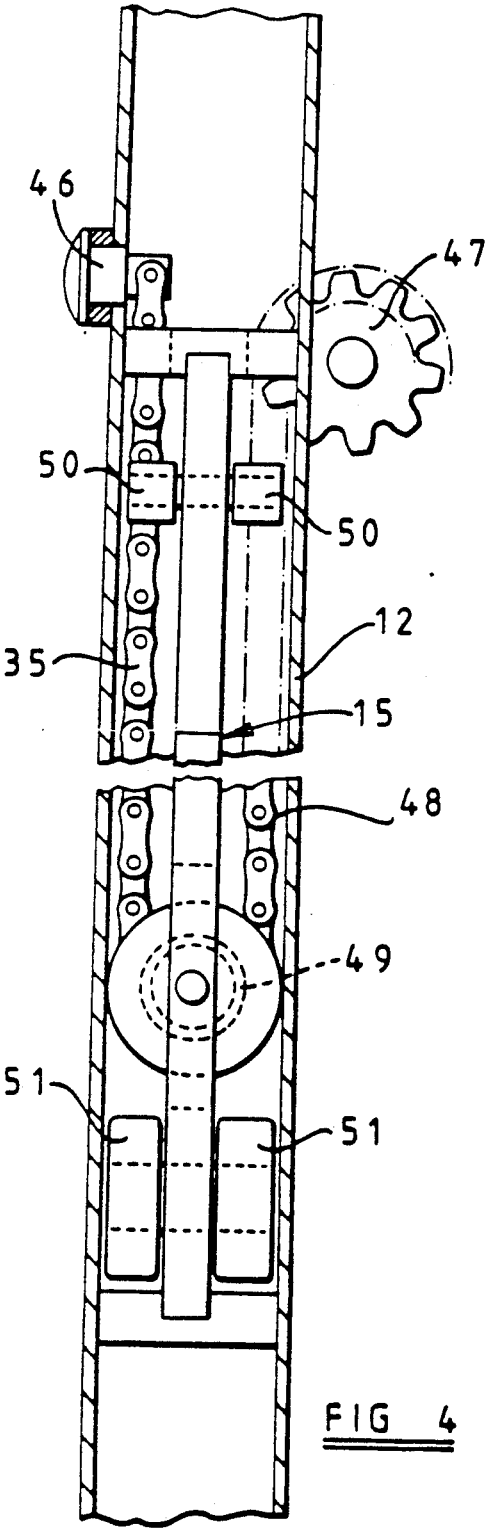
Figure 5:
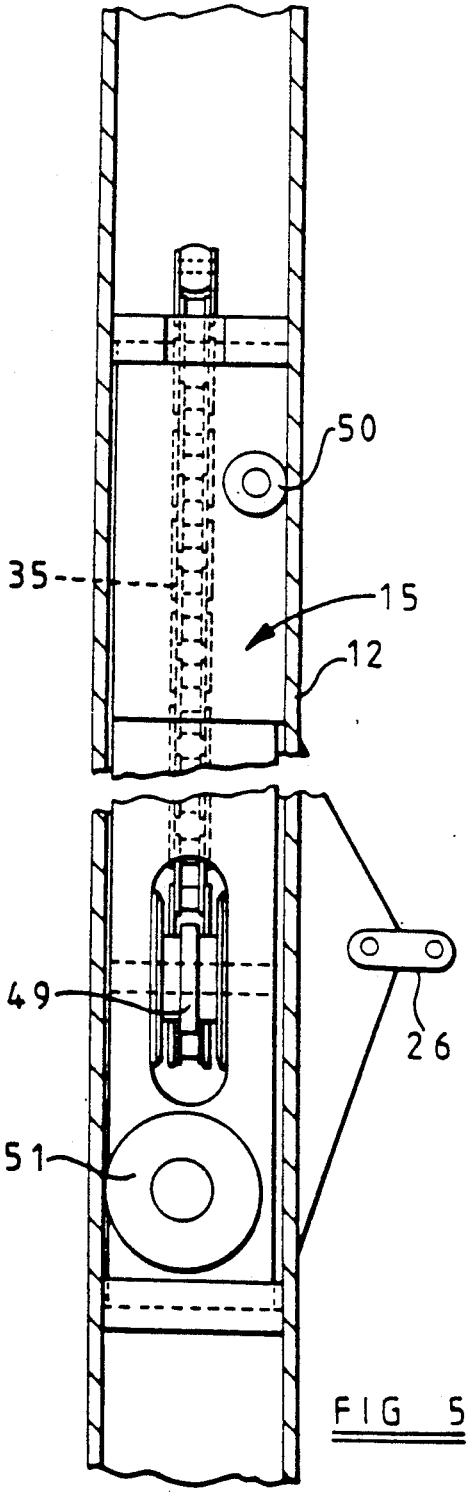

As shown in FIGS. 4, 5 and 6, the lifting mechanism 10 also comprises a rotary drive mechanism 34 and a flexible elongate element, preferably in the form of a roller chain 35, connecting the drive mechanism 34 to the carriage 15.

The drive mechanism 34 is supported in a housing 36 on a side wall of the mast 12 and comprises a drive member in the form of a sleeve 37 screwed tight to a central boss of a lever handle 24, a driven member in the form of a shaft 38, and a clutch plate in the form of an annular ratchet wheel 39. Screw threads 40 couple the sleeve 37 to the shaft 38, and the sleeve 37 is held captive relative to the shaft 38 by a stop member 41 fixed to the rearward end of the shaft 38. The stop member 41 allows a limited degree of unscrewing of the threads 40.

The ratchet wheel 39 is mounted about the shaft 38 and is engaged by a pawl 45 which is overrun when the wheel 39 is turned clockwise as viewed from behind the hoist 10 ( in the direction of arrow A in FIG. 1). An annular friction pad 42 is interposed between the ratchet wheel 39 and a flange 43 on the shaft 38 and a further annular friction pad 44 is interposed between the ratchet wheel 39 and the sleeve 37.

One end of the roller chain 35 is fixed to an anchorage 46 on the inside of the mast 12 and the other end of the chain 35 passes through an opening in the side of the mast 12 and engages with a sprocket wheel 47 fixed to the shaft 38. Between the anchorage 46 and the opening in the mast 12 the chain 35 extends in a downwards loop 48 and the closed lower end of the loop 48 passes below a guide in the form of an idler wheel 49 on the carriage 15.

The carriage 15 has two upper rollers 50 which engage the front wall of the mast 12 and two lower rollers 51 which engage the rear wall of the mast 12.

To raise the carriage 15 and hence the lifting member 13, the lever handle 24 is turned in a clockwise direction as viewed from behind the mast 12. When the handle 24 is turned in this direction the screw threads 40 tighten so clamping the sleeve 37 and flange 43 to the ratchet wheel 39. The ratchet teeth ride over the pawl and the sprocket wheel 47 turns to shorten the loop 48 in the chain 35 and thus raise the carriage 15. When the handle 24 is released the moment applied to the sprocket wheel 47 by the weight of the chain 35 and the carriage 15 acts in a sense to tighten the screw threads 40 thus ensuring that the sleeve 37 and the flange 43 remain clamped to the ratchet wheel 39. Rotation of the ratchet wheel 39 is prevented by the pawl and the movement of the carriage 15 is arrested.

To lower the carriage 15 and hence the lifting member 13, the lever handle 24 is turned anti-clockwise. This loosens the screw threads 40 and the shaft 38 slips relative to the ratchet wheel 39 until movement of the handle 24 ceases when the screw threads 40 again tighten to clamp the sleeve 37 and flange 43 to the ratchet wheel 39. Movement of the carriage 15 along the mast 12 is once more arrested.

The chain 35 may be replaced by a toothed or V-section belt that cooperates with a pulley of the drive mechanism.

In use, the hoist is wheeled up to a patient seated on a chair with the side members 18 of the chassis 11 spread apart and straddling the chair. The chords 32 of the sling 31 are released from the jamb cleats 30 and the sling 31 is placed around the back of the seated patient below the arms thereof. The patient's feet are placed on the footrest 22 with the patient's knees against the knee abutment pad 23 and the patient's hands are placed on the arms of the strut 16 to the rear of the cranked ends thereof. The slack is then taken out of the chords 32 and the latter are secured in respective jamb cleats 30. As shown in FIG. 7 the patient is then ready to be lifted to a generally standing position.

To lift the patient an attendant turns the handle 24 clockwise and the carriage 15 rides upwards in the mast 12. This movement of the carriage 15 raises the closed end of the strut 16 (as shown by arrow B in FIG. 1) and this in turn pivots the lifting member 13 upwards (as shown by arrows C in FIG. 1) to lift the patient to a generally standing position on the footrest 22 as shown in FIG. 8.

The hoist is particularly useful in facilitating the toileting of disabled or infirm persons as a single attendant can raise the patient, remove outer clothing, lower underclothing, and lower the patient onto a toilet.

The hoist could be provided with a detachable seat (not shown) which fits into sockets 52 in the side members 18 of the chassis 11. In this case, the seat may be fitted to the hoist after the patient has been raised to a generally standing position so that the patient may be lowered onto the seat and transported from one location to another in a seated position. The seat may have a central cut out aperture so as to serve as a mobile commode.

The lifting mechanism 10 places an attendant in full control of a lifting operation, as the carriage 15 and hence the lifting member 16 will remain in any positions to which they are moved by the drive mechanism 34. Moreover, the speed at which the carriage 15 is raised or lowered is easily controlled so that, for example, when lifting a patient the carriage 15 can initially be raised very slowly to apply tension to the sling and then, in order to minimise the period of discomfort to a patient, the carriage 15 can be raised rapidly.

The handle 24 turns in a vertical or near vertical plane and this keeps the space required to operate the hoist to a minimum.

The mechanical advantage provided by the lifting device 10 may be large, e.g. 16:1, so that the effort required to lift a patient is relatively low and in any event much lower than that required when using a hoist as described in GB 2 140 773.

With the self-locking drive mechanism 34 which automatically holds the carriage 15 and hence the lifting member 13 in any desired position, the effective length of the lifting member 13 can be greater than the effective length of the corresponding part of the hoist described in GB 2 140 773 and this means that the hoist can cater for both short and tall persons and the padded part of the sling 31 can be of adequate length to fit comfortably around both slim and heavily built patients.

Figure 9:
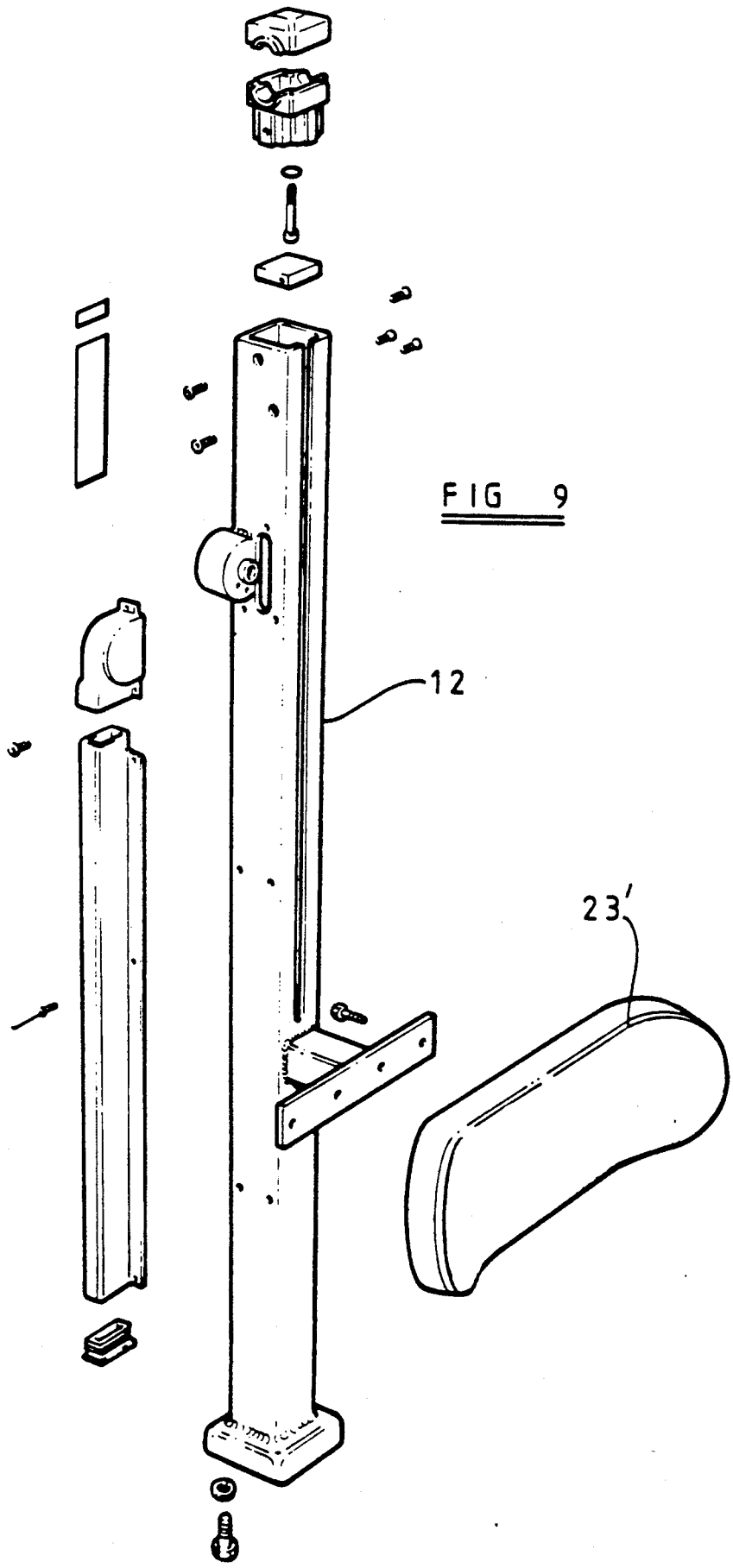
FIG. 9 is an exploded perspective view of the mast showing a modified knee abutment pad.

Referring to FIG. 9, the modified knee abutment pad 23' shown therein is shaped to provide optimum comfort.

Figure 10:
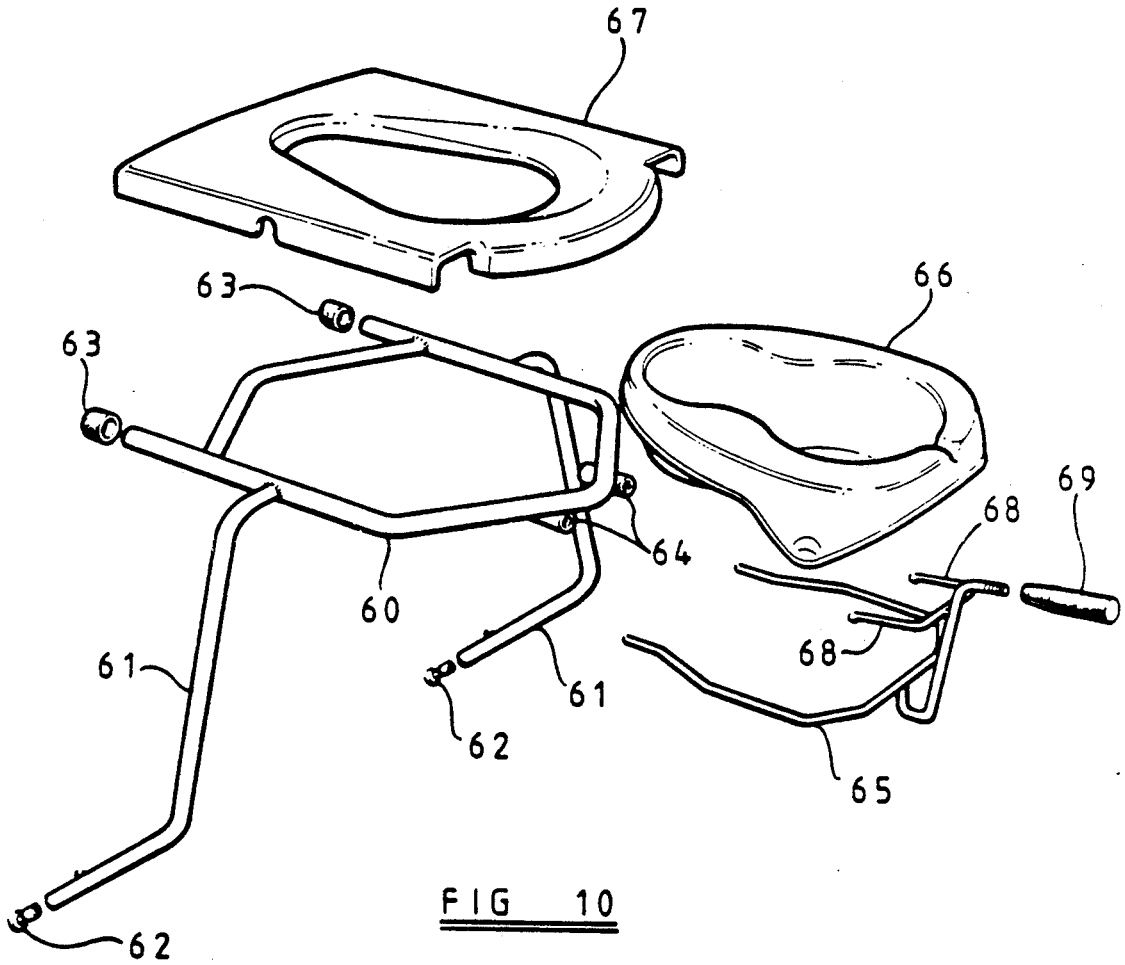
FIG. 10 is a perspective view of a detachable commode assembly for attachment to the hoist.

Referring to FIG. 10, the assembly shown therein comprises a detachable sub-frame 60 having tubular legs 61 provided with end stops 62 which fit into the sockets 52 in the side members 18 of the chassis. The sub-frame 60 also has two end stops 63 and two short tubular holders 64 with which a support 65 for a commode pan 66 engages in a manner described below. A detachable seat 67 clips onto the sub-frame 60.

With the patient lifted by the hoist to a generally standing position, the commode assembly is engageable behind the patient within the sockets 52, so that the patient may be lowered directly onto the seat 67 by the hoist. The pan 66 is supported beneath the seat 67 by the support 65 by virtue of engagement of two pins 68 on the support 65 in the holders 64. The pins 68 have enlarged ends which prevent the support 65 from becoming accidentally disengaged from the holders 64. The pan 66 may be removed from beneath the seat 67 by grasping a handle 69 on the support 65 and drawing the pins 68 out of engagement with the holders 64.

In a further non-illustrated modification of the hoist, the side members 18 of the chassis 11 are linked to a central cam mechanism which can be operated from the opposite side of the mast 12 to that on which the patient is positioned in order to spread the side members 18 apart or to move the side members 18 together. For example the cam mechanism may be operable by a lever handle which is movable from side to side and which extends immediately below the lever handle 24. Alternatively, the cam mechanism may be operable by a foot-operated treadle.

What I claim is:

1. An invalid hoist for raising inform or disabled persons from a sitting to a generally standing position, the hoist comprising a seat, a carrier movable along the mast, a U-shaped lifting member which is connected at its closed end to an upper end of the mast for pivotable movement about a horizontal axis and what at its open part provides laterally spaced attachment points for the attachment of a body sling, a U-shaped strut pivotably connected at its closed end to the carrier and at its open part to the open part of the lifting member, and operating means for raising and lowering the carrier along the mast to thereby move the attachment points along an arcuate path, the operating means being self-locking at any chosen position.

2. An invalid hoist according to claim 1, wherein the operating means comprises a rotary drive mechanism which is self-locking at any chosen position and a flexible elongate element connecting the drive mechanism to the carrier.

3. An invalid hoist according to claim 2, wherein the rotary drive mechanism includes drive and driven members screw-threadably connected together with a clutch plate therebetween, the clutch plate being rotatable only in that direction which results in raising of the carrier and in which rotation of the drive member tends to tighten the screw-threaded connection between the drive and driven members so that lowering of the carrier is achieved by rotating the drive member in an opposite direction which tends to loosen the screw-threaded connection between the drive and driven members and which allows the driven member to slip relative to the clutch plate under the force applied by the flexible elongate element only so long as the drive member continues to undergo rotation.

4. An invalid hoist according to claim 3, wherein rotation of the clutch plate in an opposite direction is prevented by a ratchet and pawl mechanism.

5. An invalid hoist according to claim 2, wherein the flexible elongate element is anchored at one end to the mast and has a downwardly extending loop between the drive mechanism and the anchoring point, the lower end of the loop passing below guide means on the carrier and the downward extent of the loop being variable by operation of the drive mechanism to raise or lower the carrier and hence the lifting member.

6. An invalid hoist according to claim 2, wherein the flexible elongate element is a chain which co-operates with a sprocket wheel of the drive mechanism.

7. An invalid hoist according to claim 1, wherein the arms of the U-shaped strut are cranked upwards near their free ends in order to provide a clearance between the arms of the strut and the arms of the lifting member when the lifting member is in a fully elevated position.

8. An invalid hoist according to claim 1, which also comprises a mobile chassis supporting the mast and foot rest.

9. An invalid hoist according to claim 8, wherein the chassis comprises a main support member on which the mast and the foot rest are provided, and two side members extending forwardly of the main support member, the side members being swivellable relative to the support member so that they can be spread apart to enable the chassis to straddle a chair on which a patient is seated.

10. An invalid hoist according to claim 9, wherein the chassis is provided with a removable seat which can be fitted into sockets in the two side members.

11. An invalid hoist according to claim 1, which includes a knee abutment supported by the mast.

12. An invalid hoist according to claim 1, wherein the body sling comprises a padded part having attachment chords at opposite ends.

13. An invalid hoist according to claim 12, wherein the attachment chords are guided through respective tubular members forming a part of the lifting member.

* * * * *